United States Patent [19]

Vignon

[11] 4,173,057

[45] Nov. 6, 1979

[54] APPARATUS FOR RECEIVING AND GATHERING A FIBRE BAND FROM A CARD OR STRETCHER

[75] Inventor: Louis Vignon, Geneva, Switzerland

[73] Assignee: Heberlein Hispano SA, Vernier-Geneve, Switzerland

[21] Appl. No.: 920,822

[22] Filed: Jun. 30, 1978

[30] Foreign Application Priority Data

Jul. 12, 1977 [CH] Switzerland ..... 5869/77

[51] Int. Cl.[2] ..... B65H 54/80

[52] U.S. Cl. ..... 19/159 R; 242/82

[58] Field of Search ..... 19/159 R, 159 A; 242/54.4, 82, 83; 100/82, 83, 85

[56] References Cited

U.S. PATENT DOCUMENTS

| | | | |
|---|---|---|---|
| 2,546,557 | 3/1951 | Naegeli | 19/159 R |
| 2,820,255 | 1/1958 | Kaiser | 19/159 R |
| 3,345,702 | 10/1967 | Miedler et al. | 19/159 R |

FOREIGN PATENT DOCUMENTS

| | | | |
|---|---|---|---|
| 1257345 | 2/1961 | France | 19/159 R |

*Primary Examiner*—Dorsey Newton

*Attorney, Agent, or Firm*—Larson, Taylor and Hinds

[57] ABSTRACT

Apparatus for receiving and gathering a fibre band from a card or stretcher is arranged for a hopper wheel to deliver the band into the top of a cylindrical tube inclined to a vertical line passing centrally through its lower end, the tube being arranged to wobble so that its longitudinal axis traces out the surface of a cone around this vertical line. This movement is effected by crank mechanism acting on the outer race of a ball bearing assembly embracing an upper portion of the tube. The lower end of the tube rests on an internal flange of a cylindrical ring that centers the lower end of the tube. The band is gathered in rings of overlapping loops contacting the inner surface of the tube. The gathered material passes through the ring and then through a tubular duct to a container at one side of the apparatus.

5 Claims, 3 Drawing Figures

APPARATUS FOR RECEIVING AND GATHERING A FIBRE BAND FROM A CARD OR STRETCHER

BACKGROUND OF THE INVENTION

The invention relates to an apparatus for receiving and gathering a fibre band from a card or from a stretcher.

It is known for fibre bands which are formed in cards to be deposited in canisters in two ways.

1. The canister rotates and the axis of the canister is displaced with respect to a plate or band guide means;

2. The canister is stationary: in this case the band guide means rotates, the guide means also being mounted on a plate whose axis of rotation is disposed in alignment with the longitudinal centre axis of the canister.

In both cases, the fibre band performs a form of hypocylic movement with respect to the inner surface of the can.

In the case of the rotating canister, in each revolution a rotary movement is imparted to the fibre band, and this rotary movement can give rise to errors in the subsequent machines, as the fibre band has a tendency to be concentrated ovr a small length and severe compression of the material becomes established in the canister. On the other hand the rotating canister has the advantage of permitting high delivery speeds in respect of the fibre band.

In the case of the stationary canister, no rotary movements are imparted to the fibre band, but it is not possible to operate at high speed.

With the very high-speed machines used nowadays, change devices are provided for the full canisters, particularly if the canisters are of relatively small diameter, as is the case in the so-called 'open-end' spinning machines. For the purposes of ensuring a satisfactory change, the machine may be temporarily stopped, but this results in a loss of production. Performing the canister change operation when the machine is operating does in fact provide a high degree of efficiency, but incidents also often occur during the change which result in the fibre strip having trailing or leading ends which cannot be used; the faster the machine is operating, the more serious are such incidents.

Another disadvantage of the known manner of depositing the fibre bands in canisters is that, as the canister is increasingly filled, the pressure of the material which has already been deposited therein and the friction between the fibre band and the band guide means increase, so that the fibre band suffers from felting more or less rapidly, and this reduces its quality.

The invention is based on the problem of avoiding the disadvantages of the known manner of depositing fibre bands in canisters, and providing an apparatus which, even when the fibre band is supplied at high speed, provides for reliable reception thereof, while avoiding the formation of defective material.

SUMMARY OF THE INVENTION

According to the invention, this problem is solved by an apparatus comprising a cylindrical tube which is arranged below the band guide means and which is inclined with respect to the horizontal and therefore to a vertical line passing centrally through the lower end of the tube, and which rests on a support member at its lower end, the tube being mounted in a ball bearing assembly around its upper half, and the outer race of the ball bearing assembly being arranged in a horizontal plate which can be displaced with a circular motion by means of two crankshafts connected to drive means.

The support member may comprise a cylindrical ring with a flange provided on its inside at its lower edge. The ring may be connected to a curved tubular duct leading to a container for collecting the gathered fibre band.

DESCRIPTION OF THE PREFERRED EMBODIMENTS

Figure 1:
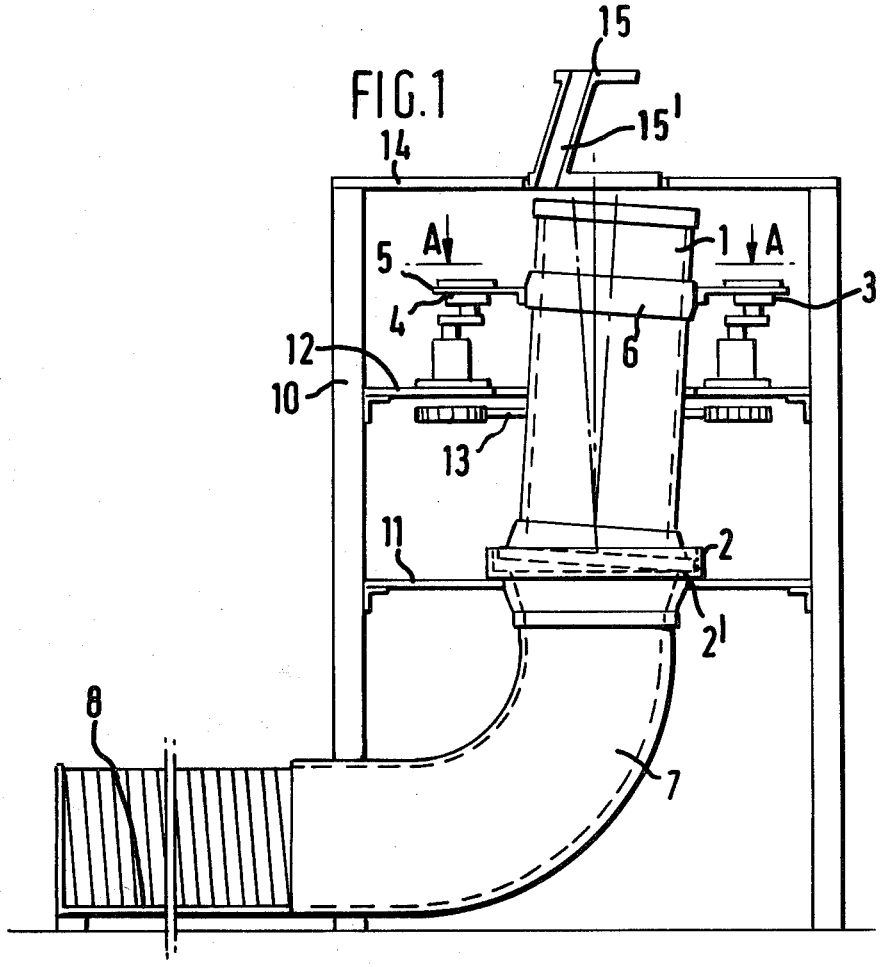
FIG. 1 is a side elevation of apparatus for gathering a fibre band.
Figure 2:
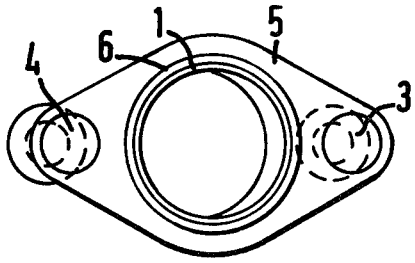
FIG. 2 is a cross-section on the line A—A in FIG. 1.

The apparatus shown in FIGS. 1 and 2 comprises a cylindrical tube 1 which is arranged in a machine frame 10 at an angle of inclination relative to a vertical line L which passes through the centre of the tube 1 at its lower end which is supported by a ring 2 with a flange 2' inside its lower edge. The ring 2 is carried on a stationary carrier plate 11 secured to a machine frame 10 and has a central opening. Nearer its upper end than its lower end the tube 1 is mounted in a ball bearing assembly 6 whose outer race is secured in a corresponding opening in the middle of a plate 5.

On opposite sides of the tube 1, the plate 5 is provided with two lateral openings through which pass respectively the crank pins of respective crankshafts 3 and 4 journalled in a fixed carrier plate 12 which is secured to the machine frame 10. The crank shafts can be rotated by means of the toothed belt drive assembly 13. The crankshafts 3 and 4 then displace the plate 5 and the centre point of the race with a circular movement, whereby the longitudinal axis of the inclined tube 1 traces out the surface T of a cone while the lower end of the tube 1 is kept central in the ring 2 while wobbling round the flange 2'.

A further carrier plate 14 with a central opening is secured to the machine frame 10, directly above the upper edge of the inclined tube 1. A conventional hopper wheel 15 which serves as a band guide means is mounted rotatably in the opening in the carrier plate 14. The hopper wheel is provided with an inclined passage 15' that rotates about the line L.

Figure 3:
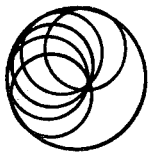
FIG. 3 is a diagrammatic plan view of the deposit of a fibre band in the apparatus of FIGS. 1 and 2.

In operation of the apparatus, the fibre band (not shown) is introduced through the passage 15' which is inclined from a point adjacent the line L, the band being deposited in the tube 1 in the manner shown in FIG. 3, due to the lower end of the passage 15' rotating within a circle the projection of which at all times is within the ambit of the top end of the tube 1. The hopper wheel rotates at a speed that is faster than the speed at which the tube 1 precesses so the fibre band is gathered in rings of overlapping loops contacting the inner surface of the tube.

The gathered fibre band which is deposited in loops in a hypocycloidal form passes through the tube 1 into a curved tubular duct 7 which is connected to the cylinder supporting ring 2. The tubular duct 7 leads the gathered band to one side of the machine from 10 where it enters a container 8, from which it can be taken mechanically or manually for further processing.

I claim:

1. Apparatus for receiving and gathering a fibre band comprising means for supporting a lower end of a cylindrical tube, a cylindrical tube mounted on said supporting means and extending upwards therefrom with the longitudinal axis of said cylindrical tube at an inclination to an imaginary fixed vertical line passing through the centre of said lower end of said tube, a ball bearing assembly embracing said tube at a location there around closer to the upper end of said tube than to said lower end, said assembly including an outer race encircling said tube with a centre point on said axis, and crank mechanism operative on said race to displace said centre point with a circular movement thereby causing said longitudinal axis of said tube to trace out the surface of a cone having its apex at said lower end of said tube.

2. Apparatus according to claim 1, in which said supporting means comprise a cylindrical ring encircling said lower end of said tube to limit lateral movement thereof and a flange extending inwards on said ring for supporting said lower end of said tube, said lower end being circular and arranged to wobble round said flange when said longitudinal axis traces said conical surface.

3. Apparatus according to claim 2, including a curved tubular duct connected peripherally at one end to said cylindrical ring and leading downwards and laterally therefrom, and a container connected to the other end of said tubular duct, said tubular duct being arranged to receive gathered fibre band from said lower end of said tube and deliver it to said container.

4. Apparatus according to claim 1, in which said crank mechanism comprises two projections extending outwards respectively on opposite sides of said race, two parallel crank shafts respectively having crank pins engaging said projections, fixed journal means for said crank shafts and means for rotating said crank shafts in said journal means simultaneously and in phase.

5. Apparatus according to claim 1, including means for delivering a continuous length of fibre band to said tube comprising a hopper wheel mounted to rotate above said tube in a horizontal plane about said vertical line and formed with an inclined passage extending downwards from a point adjacent to said vertical line to a point which, during the rotation of the hopper wheel, rotates within a circle the projection of which at all times is within the ambit of said top end of said tube and is such that fibre band can be gathered in rings of overlapping loops contacting the inner surface of the tube.

* * * * *